US006054019A

United States Patent [19]

Engström et al.

[11] Patent Number: 6,054,019

[45] Date of Patent: Apr. 25, 2000

[54] IMPREGNATION OF FIBER MATERIAL IN TWO SUBSEQUENT CONCURRENT IMPREGNATION ZONES

[75] Inventors: Johan Engström; Olav Höglund, both of Karlstad, Sweden

[73] Assignee: Kvaerner Pulping AB, Karlstad, Sweden

[21] Appl. No.: 08/973,950

[22] PCT Filed: Jul. 2, 1996

[86] PCT No.: PCT/SE96/00890

§ 371 Date: Dec. 4, 1997

§ 102(e) Date: Dec. 4, 1997

[87] PCT Pub. No.: WO97/03244

PCT Pub. Date: Jan. 30, 1997

[30] Foreign Application Priority Data

Jul. 12, 1995 [SE] Sweden ..... 9502572

[51] Int. Cl.[7] ..... D21C 3/26

[52] U.S. Cl. ..... 162/19; 162/39; 162/45; 162/62

[58] Field of Search ..... 162/17, 19, 39, 162/41, 45, 62, 86, 237, 246

[56] References Cited

U.S. PATENT DOCUMENTS 3,802,956 4/1974 Backlund ..... 162/19

5,080,755 1/1992 Backlund ..... 162/19

5,660,686 8/1997 Henricson et al. ..... 162/41

FOREIGN PATENT DOCUMENTS

WO96/07787 3/1996 WIPO .

*Primary Examiner*—Dean T. Nguyen

*Attorney, Agent, or Firm*—Fasth Law Offices; Rolf Fasth

[57] ABSTRACT

A method for cooking chips which are impregnated, in a vessel (3), with liquid in first and second concurrent impregnation zones (A, B), impregnation liquid being supplied, in a mixture with steamed chips, through a feeding system to the first impregnation zone, and liquid for recovery being extracted at a first point (41) at the end of the first impregnation zone, and further liquid being supplied to the second impregnation zone (B). According to the invention, liquid is extracted at a second point (43) at the start of the second impregnation zone (B) and is circulated in an impregnation circulation (44, 45) which empties out at the center of the vessel at a point between the first and second points (41, 43) for extraction of liquid so that a flow of liquid is established from the center of the vessel in a radial direction. The further liquid is supplied to the impregnation circulation for continued impregnation of the chips in the second impregnation zone.

10 Claims, 2 Drawing Sheets

IMPREGNATION OF FIBER MATERIAL IN TWO SUBSEQUENT CONCURRENT IMPREGNATION ZONES

TECHNICAL FIELD

The present invention relates to a method for continuous cooking of cellulose-containing fiber material which is impregnated, in a vessel, with liquid in a first cocurrent impregnation zone and a subsequent, second, cocurrent impregnation zone, the impregnation liquid, which consists of one or more of the following liquids—black liquor, white liquor, green liquor, another sulfide-containing solution and another sulfur-containing solution—being supplied, in a mixture with steamed fiber material, through a feeding system to the first cocurrent impregnation zone, and liquid for recovery being extracted at a first point situated at the end of the first cocurrent impregnation zone, and further impregnation liquid being supplied to the second cocurrent impregnation zone.

BACKGROUND AND SUMMARY OF THE INVENTION

Pre-impregnation of chips with sulfide-containing solutions accelerates the delignification and improves the selectivity in the subsequent sulfate cooking. The cooking can in this case be carried out at low kappa numbers without impairing the quality of the pulp. The strength characteristics, in particular the tearing strength, of pulp which has been cooked following such impregnation are substantially better. The improvement in the strength characteristics is retained or is even enhanced in the subsequent bleaching.

Pre-impregnation of chips is described extensively in the patent literature. Examples which may be mentioned here are EP-0 527 294, SE-359 331, SE-468 053 and SE-469 078.

However, the previously proposed methods for pre-impregnation of chips do not provide any possibility of controlling certain parameters during different parts of the impregnation, such as the $HS^-/OH^-$ ratio, in order thereby to reduce the attack by the chemicals on the carbohydrates of the hemicellulose and of the cellulose and to reduce the shive content in the pulp, after the cooking, to an even lower level than has hitherto been possible, and such as the temperature, in order thereby to improve the heat economy.

The object of the present invention is to improve the impregnation by creating conditions which are such that certain parameters can be controlled to assume different values during different parts of the impregnation.

The method according to the invention is characterized in that liquid is extracted at a second point situated at the start of the second cocurrent impregnation zone and is made to circulate in an impregnation circulation which empties out at the center of the vessel at a point situated between said first and second points for extraction of liquid so that a free flow of liquid is established from the center of the vessel in a mainly radial direction, and in that said further impregnation liquid, which consists of one or more of the following liquids—black liquor, white liquor, green liquor, liquid from a transfer circulation between the impregnation vessel and a digester, and wash liquor—is supplied to said impregnation circulation for continued impregnation of the fiber material in the second cocurrent impregnation zone. The method according to the invention thus involves a continuous two-stage impregnation in one and the same vessel.

Black liquor which is supplied to said impregnation circulation expediently has a temperature of 120–170° C.

In an expedient embodiment of the invention, in which black liquor is extracted from the digester and is transferred to a plurality of flash cyclones which are connected in series, the black liquor which is supplied through said feeding system is part of the black liquor which is extracted from the digester, or of the effluent from one of said flash cyclones, preferably the last flash cyclone but one. Under the same conditions, black liquor which is supplied to said impregnation circulation can, in the same way, expediently be part of the black liquor which is extracted from the digester, or of the effluent from one of said flash cyclones.

According to the invention, it is advantageous for the impregnation liquids to be chosen, distributed and supplied in such a way that the $HS^-/OH^-$ ratio in the feeding system is as high as possible and expediently higher than in the second impregnation stage.

According to the invention, it is expedient for the temperature in the first cocurrent impregnation zone A to be 100–140° C., preferably 120–130° C., and for the temperature in the second cocurrent impregnation zone B to be 120–160° C., preferably 130–150° C.

According to the invention, it is furthermore expedient for the dwell time of the fiber material in the first cocurrent impregnation zone A to be at least 15 minutes, and for the dwell time in the second cocurrent zone B to be at least 10 minutes.

BRIEF DESCRIPTION OF THE DRAWINGS

The invention is described in more detail hereinbelow with reference to the drawings.

DETAILED DESCRIPTION

Figure 1:
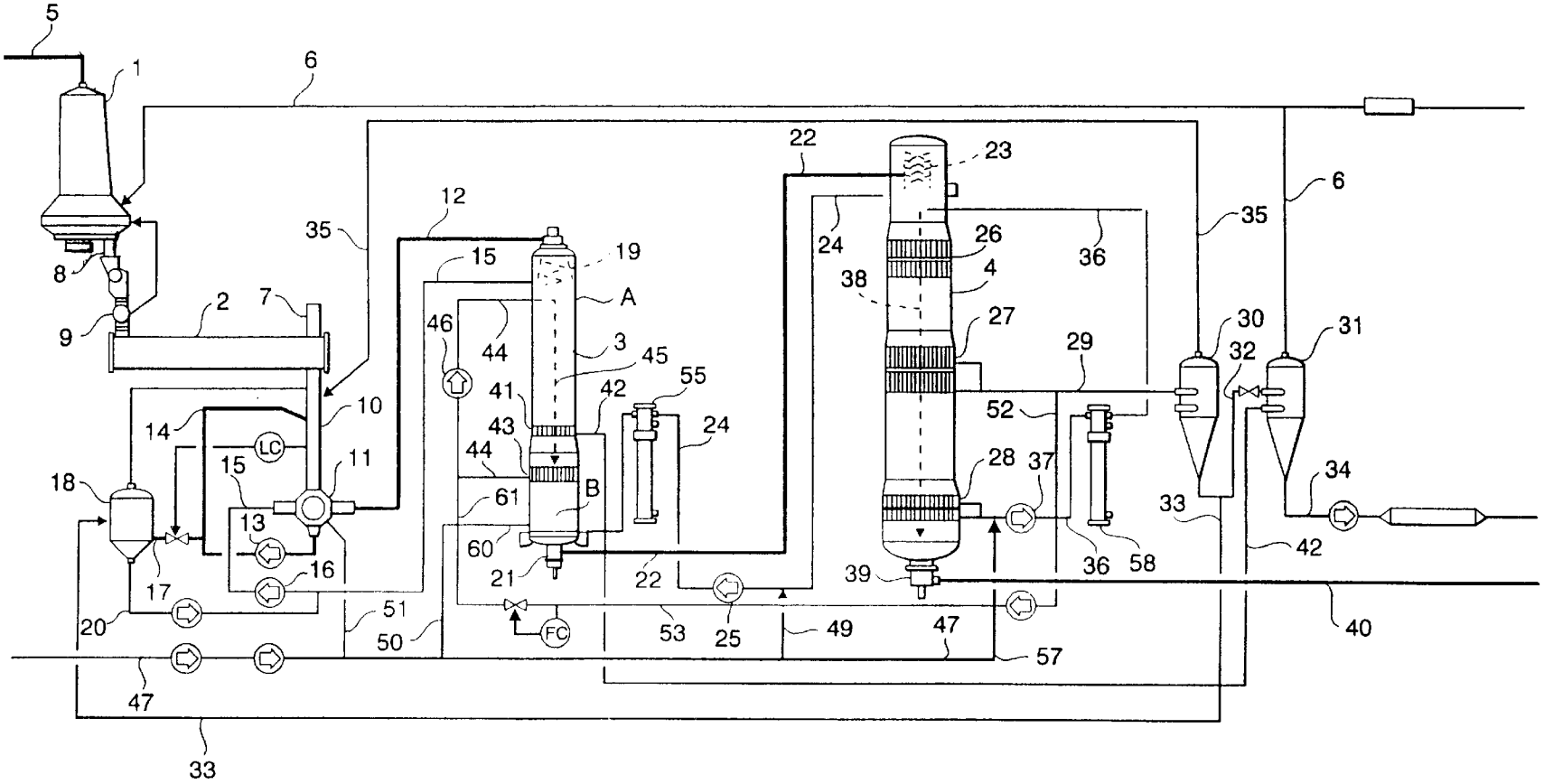
FIG. 1 shows, schematically, a flow diagram of an installation for continuous cooking of cellulose-containing fiber material, which is impregnated in accordance with a first embodiment of the present invention.

The installation shown schematically in FIG. 1 comprises a vertical steaming vessel 1, a horizontal steaming vessel 2, a vertical impregnation vessel 3, and a vertical digester 4. The fiber material, which consists of chips for example, is fed through a line 5 to the vertical steaming vessel 1, to which low-pressure steam is supplied through a line 6 in order to heat the chips and reduce their air content. The air drawn off is removed through a line 7 which is connected to the horizontal steaming vessel 2. This pre-steaming is carried out at atmospheric pressure. The heated chips are dosed using a chip meter which is arranged in a junction 8 between the two steaming vessels, which junction 8 additionally contains a low-pressure feeder 9 which channels the chips into the horizontal steaming vessel 2, in which the pressure is 1–1.5 bar above atmospheric. From the pressurized steaming vessel 2, the chips fall down into a chip chute 10, in the lower part of which a high-pressure feeder 11 is mounted. A defined liquid level is maintained in the chip chute 10. The high-pressure feeder 11 is provided with a rotor having compartments, one compartment always being in the low-pressure position so as to be in open communication with the steaming vessel 2, and at the same time one compartment always being in the high-pressure position so as to be in open communication with the impregnation vessel 3 via a feeding line 12 which is connected to the top of the impregnation vessel 3. Liquid in a circulation loop 14 provided with a pump 13 feeds the chips from the chip chute 10 into the high-pressure feeder 11 so that one of the compartments of the rotor is filled.

A return line 15 connects the upper part of the impregnation vessel 3 to the high-pressure feeder 11 for return of liquid which is separated off by means of a top separator 19 arranged in the impregnation vessel 3. The feeding line 12 and the return line 15 form a feeding system with a loop for circulation of liquid with the aid of a pump 16 which is arranged in the return line 15. When a filled rotor compartment comes into the high-pressure position, i.e. in direct communication with the circulation loop 12, 15, it is flushed clean by the return liquid from the return line 15.

The circulation loop 14 is connected to a level tank 18 via a line 17, which level tank 18 is connected in turn to the return line 15 via a line 20.

The impregnation vessel 3 has, at its bottom, an outlet 21 for the impregnated chips, from which outlet 21 the chips are transferred to the top of the digester 4 via a feeder line 22. A screen 23 is arranged at the top of the digester 4 in order to separate a certain amount of liquid, which is returned to the bottom of the impregnation vessel 3 via a return line 24, which contains a pump 25 for pumping the chips to the digester by means of the separated liquid. There is also a heat exchanger 55 in the line 24. The feeder line 22 and the return line 24 form a transfer circulation for the suspension of chips and cooking liquid.

The digester 4 has upper, middle and lower extraction screens 26, 27, 28 for extraction of liquor at different levels. The middle extraction screen 27 is connected by a line 29 to a first flash cyclone 30, which is connected to a second flash cyclone 31 via a line 32 and to said level tank 18 via a line 33. Effluent from the second flash cyclone 31 is conveyed via a line 34 to a recovery installation (not shown). The steam formed in the flash cyclones 30, 31 is conveyed through the line 35 and the line 6 to the chip chute 10 and the steaming vessel 1, respectively. The lower extraction screen 28 is connected to a line 36 which is provided with a pump 37 and heat exchanger 58 and which extends to the upper part of the digester in order there to join up with a central pipe 38 which opens out underneath the lower extraction screen 28. By means of this circulation, an increased velocity of flow of the black liquor is achieved, with the result that the discharge of the cooked chips is facilitated via an outlet 39 which is arranged at the bottom of the digester 4. The cooked pulp is led away through a line 40 for continued treatment.

The impregnation vessel has a first extraction screen 41, which is arranged at the middle of the impregnation vessel 3 or immediately below the middle, for extraction of liquid which is led away via a line 42 to the second flash cyclone 31. At a distance from the bottom of the impregnation vessel 3, and at a short distance below the first extraction screen 41, there is a second extraction screen 43 for extraction of liquid in a circulation loop consisting of a line 44, which extends to the upper part of the impregnation vessel 3, and a central pipe 45, to which the line 44 is joined, said line 44 containing a pump 46 for circulation of liquid through the line 44 and the central pipe 45. The central pipe 45 opens out at the upper end of the extraction screen 43. The pumped liquid flows out of the central pipe at great speed, in the main radially out toward the screen surfaces of the extraction screen.

From a storage area, white liquor is supplied to the system via a main line 47 which is connected via a line 48 to the line 36 for supplying a certain amount of white liquor to the discharge circulation of the digester, is connected via a line 49 to the return line 24 for supplying a certain amount of white liquor to the transfer circulation between the impregnation vessel 3 and the digester 4, is connected via a line 50 to the line 44 for supplying a certain amount of white liquor to the impregnation circulation, and is connected via a line 51 to the chip outlet of the high-pressure feeder 11, which chip outlet joins up with the feeding line 12.

Black liquor is fed to the feeding circulation from the last but one flash cyclone 30, which is the first one in the embodiment shown, through the line 33 to the level tank 18 and onward through the line 20 to the return line 15. In addition, black liquor is transferred from the middle extraction screen 27 of the digester to the impregnation circulation through a line 52 which is provided with a pump 57 and which is coupled between the line 29 and the circulation line 44.

The impregnation of the chips in the impregnation vessel 3 takes place in cocurrent the whole time. The impregnation liquid fed in at the top consists of warm black liquor and white liquor. If so desired, warm green liquor, modified green liquor or another sulfide-containing or sulfur-containing solution can also be included in the impregnation liquid. The material fed in at the top has a liquid/wood ratio of 2.5:4.0 or greater. By means of the circulation screen 43, the impregnation vessel 3 is divided up into a first cocurrent impregnation zone A and a second cocurrent impregnation zone B, which begins with the circulation screen 43. The dwell time for the chips is at least 15 minutes in the first cocurrent impregnation zone A and at least 10 minutes in the second cocurrent impregnation zone B, and so the overall dwell time can be at least 25 minutes. The temperatures in the two cocurrent impregnation zones A, B can be identical or different and lie within the range from 100 to 140° C. and 120 to 160° C., respectively. For reasons of heat economy, it is advantageous to maintain a higher temperature in the second cocurrent impregnation zone B. At the end of the first cocurrent impregnation zone A, liquid is extracted and is transferred to the last flash cyclone 31 via the line 42.

With the aid of the impregnation circulation, white liquor and hot black liquor, transferred from the extraction screen 27 of the digester, are supplied to the passing pre-impregnated chips from which part of the liquid content has been extracted immediately beforehand. The impregnation circulation generates a high liquid flow through the chips, as circulated liquid supplemented by hot black liquor and white liquor flows out in the center of the impregnation vessel 3 level with the circulation screen 43, which liquid flow acquires a mainly radial direction. The circulation flow with such a radial displacement of liquid serves to distribute and balance out the white liquor which is continuously added to the impregnation circulation, and also the black liquor which at the same time is supplied for continued and final impregnation of the chips in the second cocurrent impregnation zone B. This ensures a very even alkali and temperature profile in the second cocurrent impregnation zone B.

In the impregnation procedure which has been described, and which can thus be designated as a two-stage procedure, it is possible to maintain a high and favorable $HS^-/OH^-$ ratio in the first phase. Having a high $HS^-$ content at the same time as the $OH^-$ content is low permits a maximum sorption of sulfide ions in the chips, while the attack on the carbohydrates of the hemicellulose and of the cellulose is minimized. In the second phase of impregnation, alkali is added so that the $HS^-/OH^-$ ratio becomes lower, and in this way it is possible to ensure that the shive content in the pulp after cooking will be at a lower level than that which is achieved when there is no such control of said ratio. With this two-stage procedure, it is also possible to have different temperatures in the two phases. The temperature can be low in the first phase, while the temperature in the second phase is raised with the aid of hot black liquor. By heating the chips directly in this way with hot black liquor, the heat economy is also improved.

Figure 2:
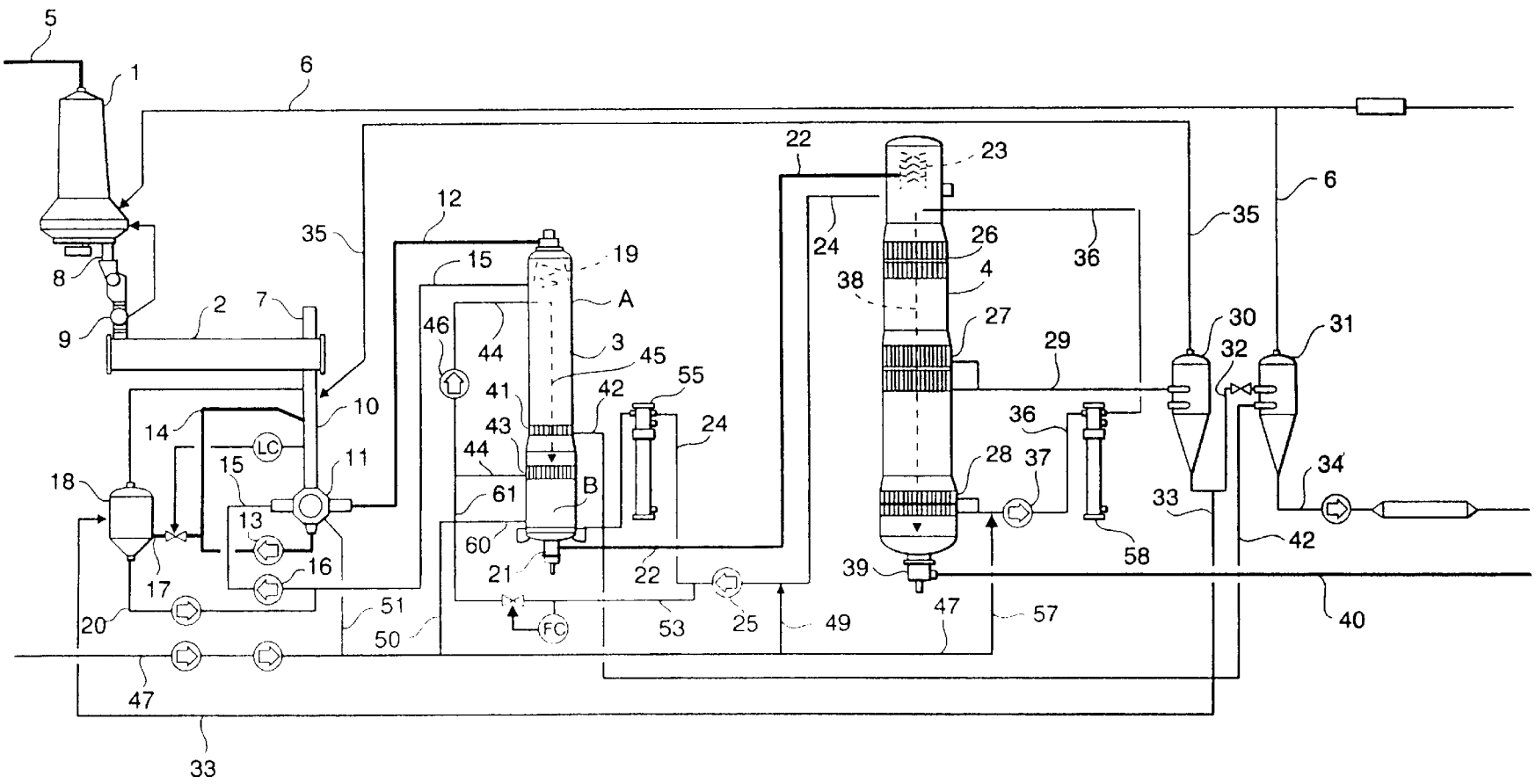
FIG. 2 shows a similar installation, but modified for impregnation according to a second embodiment.

The installation shown schematically in FIG. 2 is similar to that in FIG. 1, with the sole exception of the liquid which is supplied to the impregnation circulation. According to this second embodiment, a line 53 is coupled between the return line 24 and the line 44 for supply of transfer liquid, instead of black liquor, to the impregnation circulation.

The choice between the two embodiments depends on the demands placed on heat economy. The amount of the liquid which is extracted through the screen 41 is smaller than the free liquid in the first cocurrent impregnation zone A in order thereby to prevent a counterflow of liquid from the vessel space below this screen 41.

While the present invention has been described in accordance with preferred compositions and embodiments, it is to be understood that certain substitutions and alterations may be made thereto without departing from the spirit and scope of the following claims.

We claim:

1. A method for continuous cooking of cellulose containing fiber material, the method comprising the steps of:

providing an Impregnation vessel having a first and a second concurrent impregnation zone, the second concurrent impregnation zone being subsequent to the first concurrent impregnation zone, the first impregnation zone having a $HS^-/OH^-$ ratio that is greater than a $HS^-/OH^-$ ratio in the second concurrent impregnation zone;

providing a first impregnation liquid in a mixture with a steamed fiber material;

feeding the mixture to the first concurrent impregnation zone;

impregnating the fiber material with the first impregnation liquid in the first concurrent impregnation zone;

extracting a recovery liquid at a first point that is at an end of the first concurrent impregnation zone;

providing a second impregnation liquid to the second concurrent impregnation zone, the second impregnation liquid containing at least one liquid selected from the group consisting of black liquor, green liquor and washing liquid;

impregnating the fiber material with the second impregnation liquid in the second concurrent impregnation zone;

extracting a circulation liquid at a second point that is at a beginning of the second concurrent impregnation zone;

circulating the circulation liquid in an impregnation circulation;

feeding a white liquor to the impregnation circulation;

discharging the circulation liquid at a center of the impregnation vessel at a third point that is disposed between the first point and the second point;

establishing a free flow of the circulation liquid at the center of the impregnation vessel in a direction that is mainly radial; and continuously cooking the fiber material to form pulp fiber.

2. The method according to claim 1 wherein the step of providing the first impregnation liquid comprises the step of providing the first impregnation liquid with a liquid selected from the group consisting of black liquor, white liquor, green liquor, sulfide-containing solution and a sulfur-containing solution.

3. The method according to claim 2 wherein the method further comprises the steps of extracting a black liquor from a digester and transferring the extracted black liquor to a plurality of flash cyclones that are connected in series and the step of feeding comprises the step of providing the mixture with a portion of the black liquor extracted from the digester.

4. The method according to claim 3 wherein the step of providing the mixture comprises the step of providing the mixture with an effluent from one of the flash cyclones.

5. The method according to claim 1 wherein the step of circulating the circulation liquid comprises the step of providing the circulation liquid with a black liquor having a temperature of between about 120° C. and about 170° C.

6. The method according to claim 1 wherein the method further comprises the steps of extracting a black liquor from a digester and transferring the extracted black liquor to a plurality of flash cyclones that are connected in series and the step of circulating comprises the step of providing the circulation liquid with a portion of the black liquor extracted from the digester.

7. The method according to claim 1 wherein the step of providing the first impregnation liquid comprises the step of choosing the first impregnation liquid to maximize a $HS^-/OH^-$ ratio in a feeding system.

8. The method according to claim 1 wherein the step of providing the impregnation vessel further comprises the step of providing the first concurrent impregnation zone with a temperature of about 100–140° C. and the second concurrent impregnation zone with a temperature of about 120–160° C.

9. The method according to claim 1 wherein the step of providing the impregnation vessel further comprises the step of providing the first concurrent impregnation zone with a temperature of about 120–130° C. and the second concurrent impregnation zone with a temperature of about 130–150° C.

10. The method according to claim 1 wherein the step of providing an impregnation vessel further comprises the step of providing the first concurrent impregnation zone with a dwell time of at least 15 minutes and providing the second concurrent impregnation zone with a dwell time of at least 10 minutes.

* * * * *